US008418280B2

(12) United States Patent
Schwerzmann

(10) Patent No.: US 8,418,280 B2
(45) Date of Patent: Apr. 16, 2013

(54) DRIVE DEVICE FOR THE COVER OF A LIQUID CONTAINER

(76) Inventor: Arthur Schwerzmann, Oberwil b. Zug (CH)

( * ) Notice: Subject to any disclaimer, the term of this patent is extended or adjusted under 35 U.S.C. 154(b) by 5 days.

(21) Appl. No.: 13/145,026

(22) PCT Filed: Sep. 13, 2010

(86) PCT No.: PCT/EP2010/063416

§ 371 (c)(1),
(2), (4) Date: Jul. 18, 2011

(87) PCT Pub. No.: WO2011/032920

PCT Pub. Date: Mar. 24, 2011

(65) Prior Publication Data

US 2011/0277945 A1 Nov. 17, 2011

(30) Foreign Application Priority Data

Sep. 18, 2009 (EP) ..... 09170777

(51) Int. Cl.
*E04H 4/00* (2006.01)

(52) U.S. Cl.
USPC ..... 4/502; 242/390.8; 242/394

(58) Field of Classification Search ... 4/502; 242/390.8, 242/394
See application file for complete search history.

(56) References Cited

U.S. PATENT DOCUMENTS

| | | | | |
|---|---|---|---|---|
| 3,050,743 | A * | 8/1962 | Lamb | 4/502 |
| 3,144,665 | A * | 8/1964 | Meyer | 4/502 |
| 4,402,101 | A * | 9/1983 | van Zyl | 15/1.7 |
| 4,494,256 | A * | 1/1985 | Radtke et al. | 4/502 |
| 4,955,092 | A * | 9/1990 | Hagan | 4/502 |
| 5,761,750 | A | 6/1998 | Mazzola et al. | |

FOREIGN PATENT DOCUMENTS

| | | | |
|---|---|---|---|
| DE | 23 58 755 | A1 | 6/1975 |
| DE | 27 56 738 | A1 | 7/1978 |
| DE | 28 54 738 | A1 | 7/1980 |
| EP | 1 754 846 | A1 | 2/2007 |
| FR | 2 577 264 | A1 | 8/1986 |
| FR | 2577264 | A1 * | 8/1986 |
| FR | 2 607 173 | A1 | 5/1988 |

OTHER PUBLICATIONS

International Search Report mailed Jan. 11, 2011 issued in International Patent Application No. PCT/EP2010/063416 (with translation).

* cited by examiner

*Primary Examiner* — Gregory Huson
*Assistant Examiner* — Janie Christiansen
(74) *Attorney, Agent, or Firm* — Oliff & Berridge, PLC

(57) ABSTRACT

The drive device, which serves for the transport of the cover of a liquid container, particularly a swimming pool, is installed or installable in device compartment, which is arranged separate from the liquid container. The drive device includes at least one winding shaft that interacts with the cover and that is coupled to a first drive unit. The winding shaft serves for the rolling-up of the cover, which can be guided over a deflection device to an outlet opening of the device compartment and, at the end facing the winding shaft, is connected to an outer tractive element, which is acting against the side of the cover that is opposite to the side which faces the deflection device, which outer tractive element presses cover under tension against the deflection device, and which outer tractive element is held and can be tensioned by a first traction device.

15 Claims, 8 Drawing Sheets

DRIVE DEVICE FOR THE COVER OF A LIQUID CONTAINER

Figure 1:
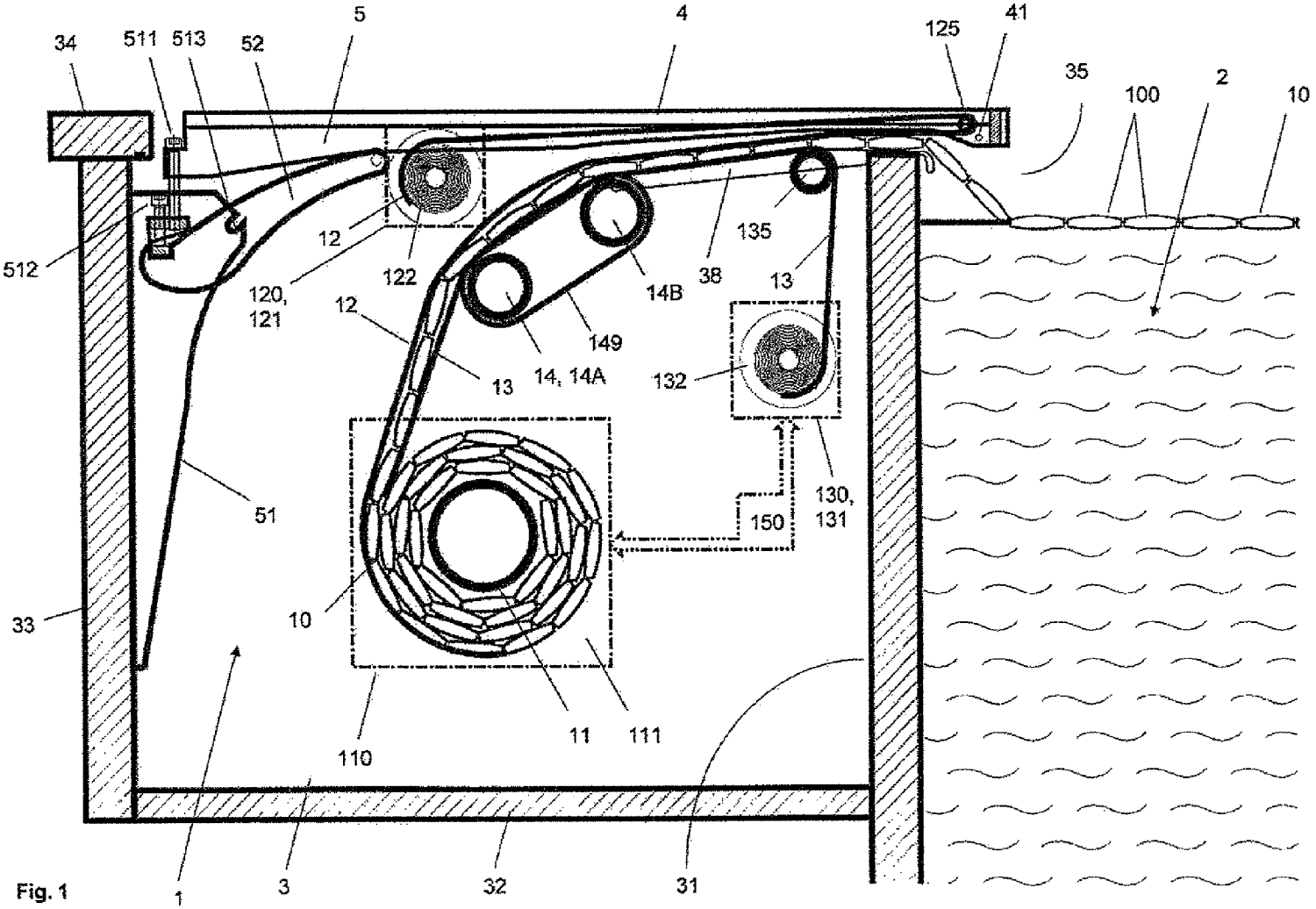

The present invention relates to a drive device for the cover of a liquid container, particularly a swimming pool, according to the preamble of claim 1.

As described in [1], DE2756738A1, a cover of a swimming pool serves for example for the thermal insulation. By the cover of a swimming pool, a rapid cooling of the water can be avoided. Further, the cover serves as a protective device which prevents that children could fall into the water. Furthermore, the cover prevents that leaves and dirt can get into the water. If required the cover can be designed to be walkable or at least be capable of supporting a load, such as a layer of snow. Usually, covers are used, that consist of bar-shaped profile elements that are flexibly coupled with one another.

Most often buoyant profile elements are used. However, in [2], EP1754846A1, it is suggested to provide support rails on both sides of the swimming pool, on which the ends of the profile elements can be seated. Furthermore, in [2] the use of a pin is disclosed, on which the flat cover can be wound. The pin can manually be driven with a crank, in order to pull the cover off the swimming pool. In order to cover the swimming pool again, the pin is released and the cover is manually pulled off the pin. An automation of the device for unrolling and rolling-up of the cover is not even then possible with this device, when the pin is driven by means of a motor.

[3], U.S. Pat. No. 5,761,750A describes a cover which can be moved by means of a drive device forth and back over a bath tub. For this purpose a compartment is provided outside the bath tub, in which a sprocket wheel is provided that is supported by means of a drive shaft of a motor. The sprocket wheel can engage with sprockets into grooves provided in profile elements of the cover, in order to move them forth and back. Thereby the cover is not wound onto the sprocket wheel, but is shifted passing by the sprocket wheel into a storage channel that is adapted to the cover. The device therefore requires a drive device and a cover, which are specially adapted to one another. Furthermore, this device is limited to smaller pools, because the storage channel can only accommodate a small number of flexibly interconnected profile elements and because the storage channel and the drive device themselves require a lot of space. Furthermore, the entire device with the sprocket wheel, the correspondingly adapted profile elements of the cover and the required storage channel are relatively complex in design.

However, said problems of insulation, security and prevention of contamination occur not only in swimming pools, but also in liquid containers, which may be used for example in production sites of the chemical industry or in the beverage production.

The present invention is therefore based on the object of creating an improved drive device, which allows extending and again retracting the cover of a liquid container, in particularly of a swimming pool.

In particular, a drive device shall be created which allows driving any cover that swims on the water or that is guided along guiding surfaces.

Further, the drive device shall require little space and shall not require a storage channel, so that larger covers can be accommodated within the room, in which the drive device is located.

SUMMARY OF THE INVENTION

This object is achieved with a drive device for a liquid container, in particular for a cover for a swimming pool, comprising the features of claim 1. Preferred embodiments of the invention are defined in further claims.

The drive device, which serves for the transport of a cover of a liquid container, particularly a swimming pool, and with which the flexible cover can be pushed over the swimming pool and can be retracted therefrom again, is installed or installable in a device compartment, which is arranged separate from the liquid container. The drive device comprises at least one winding shaft, if appropriate a pin or a reel, that interacts with the cover and that is coupled to a first drive unit.

The cover preferably consists of bar-shaped profile elements, which are flexibly coupled with one another. For example, the profile elements are connected with one another by means of articulated joints or elastic materials. The profile elements are preferably firm and exhibit a low specific weight, so that they either can swim on the water surface of the swimming pool or can glide along guide rails.

According to the invention the winding shaft serves for rolling-up the cover, that can be guided over a deflection device to an outlet opening of the device compartment and, at the end facing the winding shaft, is connected to an outer tractive element, which is acting against the side of the cover that is opposite to the side which faces the deflection device, which outer tractive element presses the cover under tension against the deflection device, and which outer tractive element is held and can be tensioned by a first traction device.

With the tensioning of the one or more outer tractive elements the cover is reeled from the winding shaft, guided over the deflection device and pushed out over the liquid container.

When rolling up or unrolling the cover the diameter of the coiled cover changes continuously. In order to run these processes optimally, the deflection device is preferably rotatably supported. In this way, the corresponding end of the deflection device, such as a skid, can follow the changing diameter of the coiled cover.

Ideally, the outer tractive element and the cover are aligned in parallel during the process of unrolling. This is achieved particularly advantageously especially then, when the deflection device comprises glide elements or one or more pulleys, which are arranged along a correspondingly designed body. Further, a plurality of pulleys can be used, that are surrounded by an endless belt. If the pulleys and/or or the endless belt are driven, then the transport is further facilitated.

In order to obtain a transmission of force from the outer tractive element and the deflection device to the cover, the deflection device is preferably arranged and/or designed in such a way, that the cover does not run in a straight line, but on a detour to the outlet opening of the device compartment. In a preferred embodiment, the body of the deflection device, which preferably extends from the winding shaft to the outlet opening, is designed curve-shaped. Due to rotatably supporting and or due to the curve-shaped design of the body the cover runs always along a curve-shaped path, for which reason a uniform force distribution is achieved.

The deflection device may be positioned on one or the other side of the line between the winding shaft and the outlet opening. Changing between the two alternatives entrains merely a kinematic reversal. The at least one outer tractive element and the cover proceed preferably in the range of the outlet opening synchronously and in parallel.

Pressing the cover to the deflection device results in an application of force from both sides to the cover, so that the cover is driven without slip. If several outer and possibly several inner tractive elements are provided, then they are distributed preferably at equal intervals along the winding shaft, thereby ensuring a uniform application of force to the cover. For this purpose individual or combined tractive devices can be used. For example tractive devices with several reels can be applied, which are driven by a single reel shaft.

In preferred embodiments, at least one inner tractive element is provided on the side of the cover opposite to the outer tractive element, which can also be wound around the winding shaft and which is held and can be tensioned by a second traction device. Thereby, the cover is held from both sides with the at least one inner tractive element and with the at least one outer tractive element and synchronously guided there between. Said outer and inner tractive elements, as well as the deflection device, define a path, along which the flexible cover is guided.

The second traction device comprises preferably a reel that is driven by the first or a third drive unit, which reel serves for rolling-up the inner tractive element.

Therefore, by tensioning the outer tractive element and the inner tractive element the cover is driven outwards and transported through the outlet opening to the outside. In a preferred embodiment, the tractive elements are deflected near the outlet opening and are guided to the tractive devices, which, combined or separately, are driven preferably electrically.

Alternatively, also other drive devices or tractive devices, respectively, can be used, which operate for example by a spring force.

The at least one outer tractive element is guided over an upper exit pulley to the first traction device. The inner tractive element is guided over a lower exit pulley to the second traction device, therein the upper exit pulley and/or the lower exit pulley are located as close as possible at the outlet opening of the device compartment, so that the cover is optimally guided and transported in this range.

The outer tractive element and the inner tractive element are preferably made from plastic, metal or textile material. For example, flat belts or ropes can be used as tractive elements. The dimensions of the tractive elements are selected depending on the used materials. For example, ribbon-like tractive elements with a breadth of 2 cm to 5 cm are selected, which act forcefully but gently on the cover. however, ribbon-like tractive elements can also be selected in a broader range with a breadth for example of 1 cm to 20 cm. Wire ropes can exhibit a minimum diameter and only require little space, but are used preferably only then, when the cover is reinforced accordingly at the exposed sectors. The spools or reels, on which the tractive elements are wound, are adapted to the used tractive elements.

Preferably, the ends of the tractive elements are directly connected with the winding shaft. Furthermore, the tractive elements are preferably connected to the cover in such a way, that one end of the tractive element, which can be connected to the winding shaft, is freely exposed. In this way, the cover can easily be connected by means of the tractive elements with the winding shaft.

While the tractive devices serve for the unrolling of the cover, the device is retracted and wound up again by the central winding shaft. For this purpose, the winding shaft is preferably driven in both directions and controlled accordingly. In this manner a load relief is achieved on the tractive devices when the cover is pulled out. If a plurality of electrical drives is operated simultaneously, then these drives are synchronised accordingly by means of an electrical control unit. If however only one drive unit is provided, then the winding shaft and the at least one reel shaft are not coupled firmly, but via compensating devices, such as a differential gears, friction clutches or sliding-hubs.

For example, the drive shaft of a single drive unit, preferably an electro motor, is coupled via a first mechanical compensating device, e.g. a differential gear or a sliding-hub and a free-wheel, with a first reel shaft of the first traction device. If a second traction device is provided, then the drive shaft of the first drive unit or the first reel shaft of the first traction device is coupled via a second mechanical compensating device, e.g. a differential gear, an elastic connection device or a sliding-hub and a free-wheel, with a second reel shaft of the second traction device. The compensating devices ensure, that the rotational speeds of the drive shaft, which is preferably firmly coupled with the winding shaft, and the reel shafts are adapted to one another, so that the outer and the inner tractive elements are pulled with constant force and are equally tensioned. The cover is therefore always uniformly guided and correctly up-rolled and unrolled. Malfunctions or disturbances of the drive device when extending the cover, which would require interventions by the user or maintenance personnel, are avoided. Through the use of the compensating devices an optimal interaction of the various components of the drive device is achieved. In order to ensure uniform unrolling of the cover, preferably to or more outer tractive elements and preferably also inner tractive elements are provided that are driven by the related first or second reel shaft.

In preferred embodiments, the winding shaft is driven by a motor that preferably is integrated into the winding shaft and therefore does not require further space and in addition is optimally protected.

The device compartment can preferably be covered by means of a lid, which on one side or the other is pivotally held or is supported by the edge of the pool. For example, axles or hinges are used, in order to pivotally support the lid. In this way, it is easily possible to reach into the device compartment, which is not flooded, in order to perform maintenance work. It is also possible to open the lid and to draw the cover to the other side and to lay it down, e.g., on lawn, in order to perform inspection of material or to perform cleaning work.

The lid is thereby mounted in such a way that between the pool wall, which separates the device compartment from the swimming pool, and the lid the slot-like outlet opening is kept free, so that the cover can freely be transported through the outlet opening.

In a preferred embodiment at least one bracket is mounted within the device compartment at the outer wall opposite the pool wall, which bracket serves for holding a support arm, which is connected to the lid and stabilises the latter.

Figure 2:
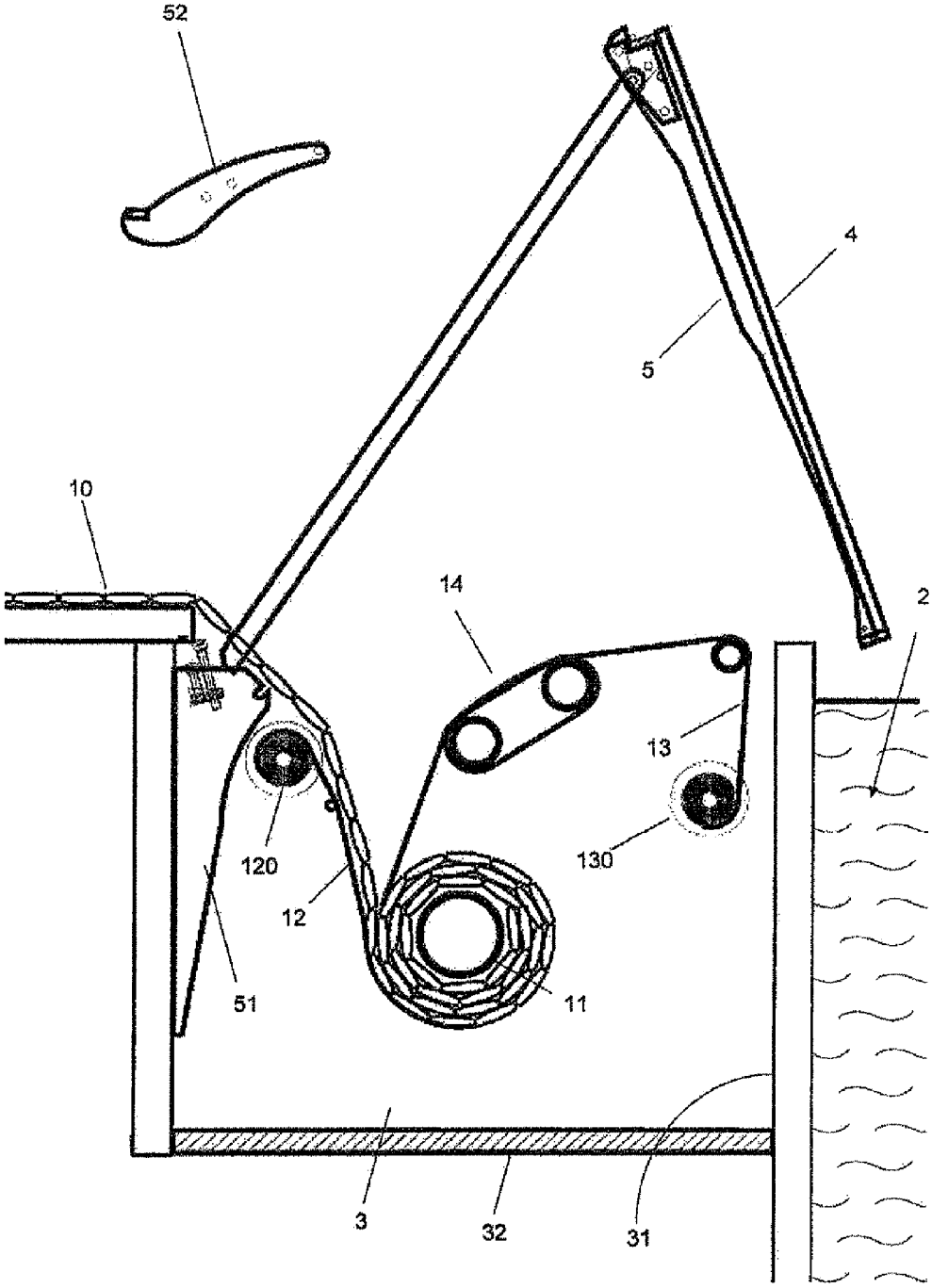
Figure 3:
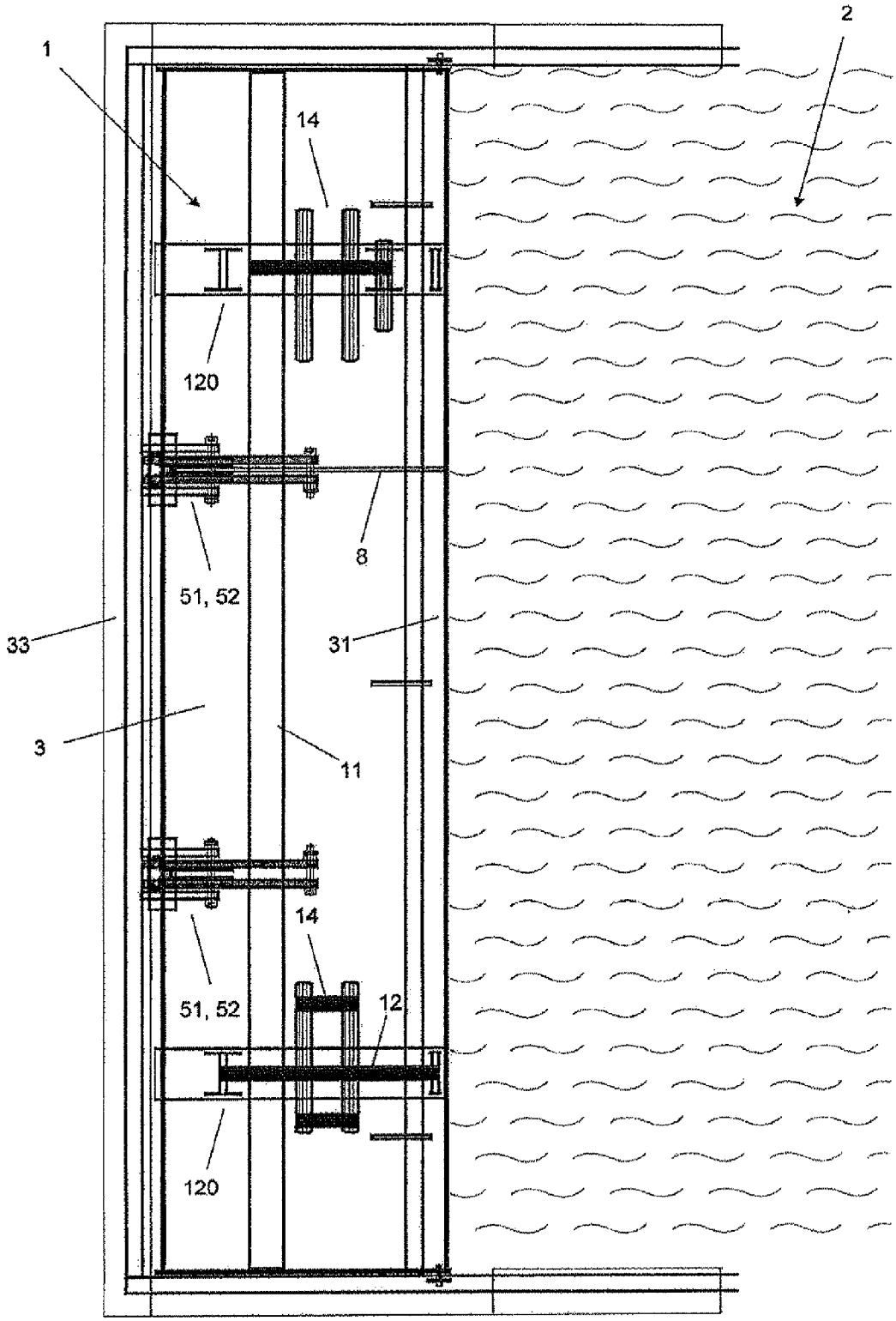
Figure 4A:
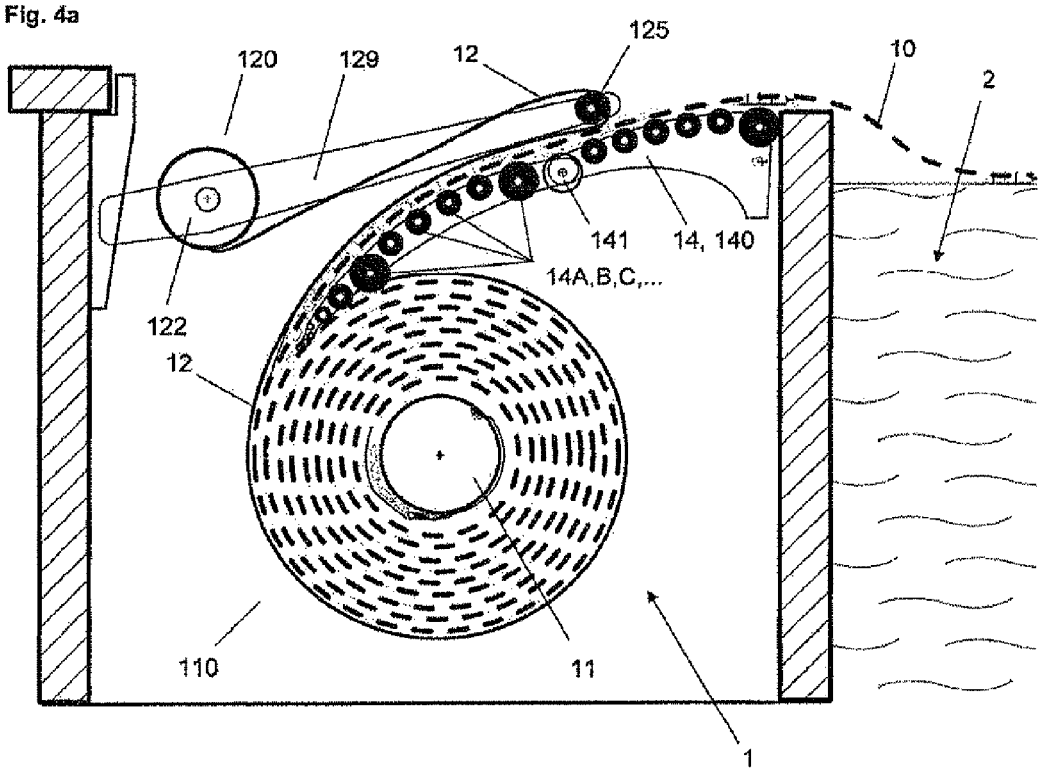
Figure 4B:
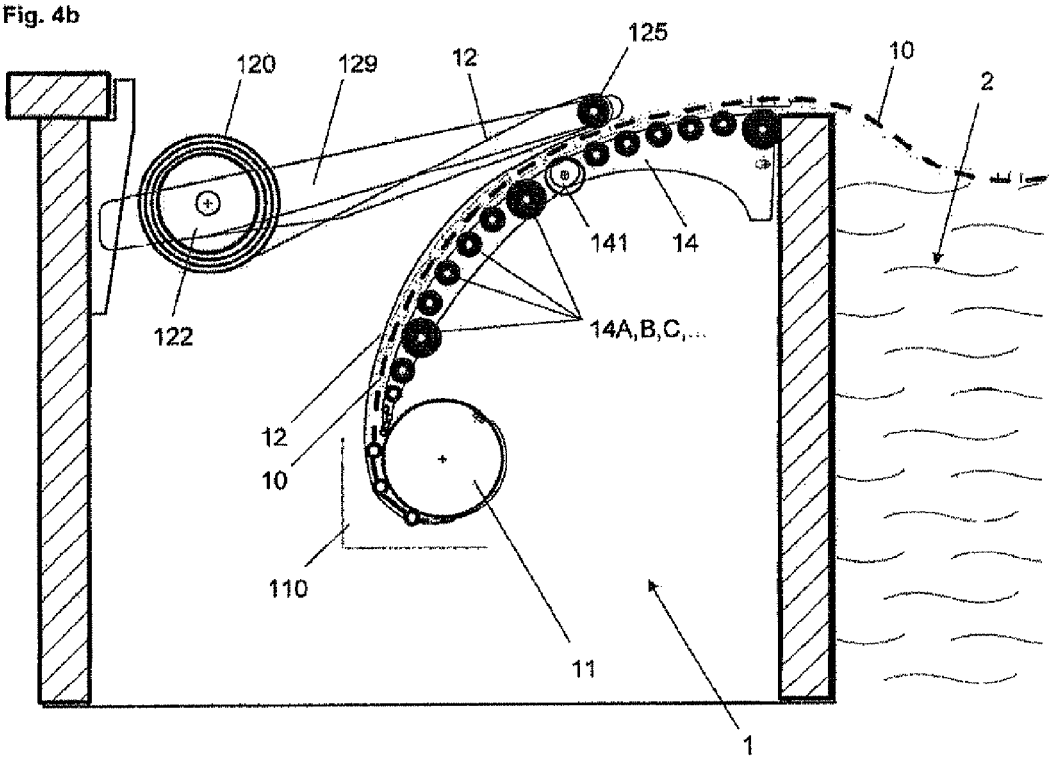
Figure 5:
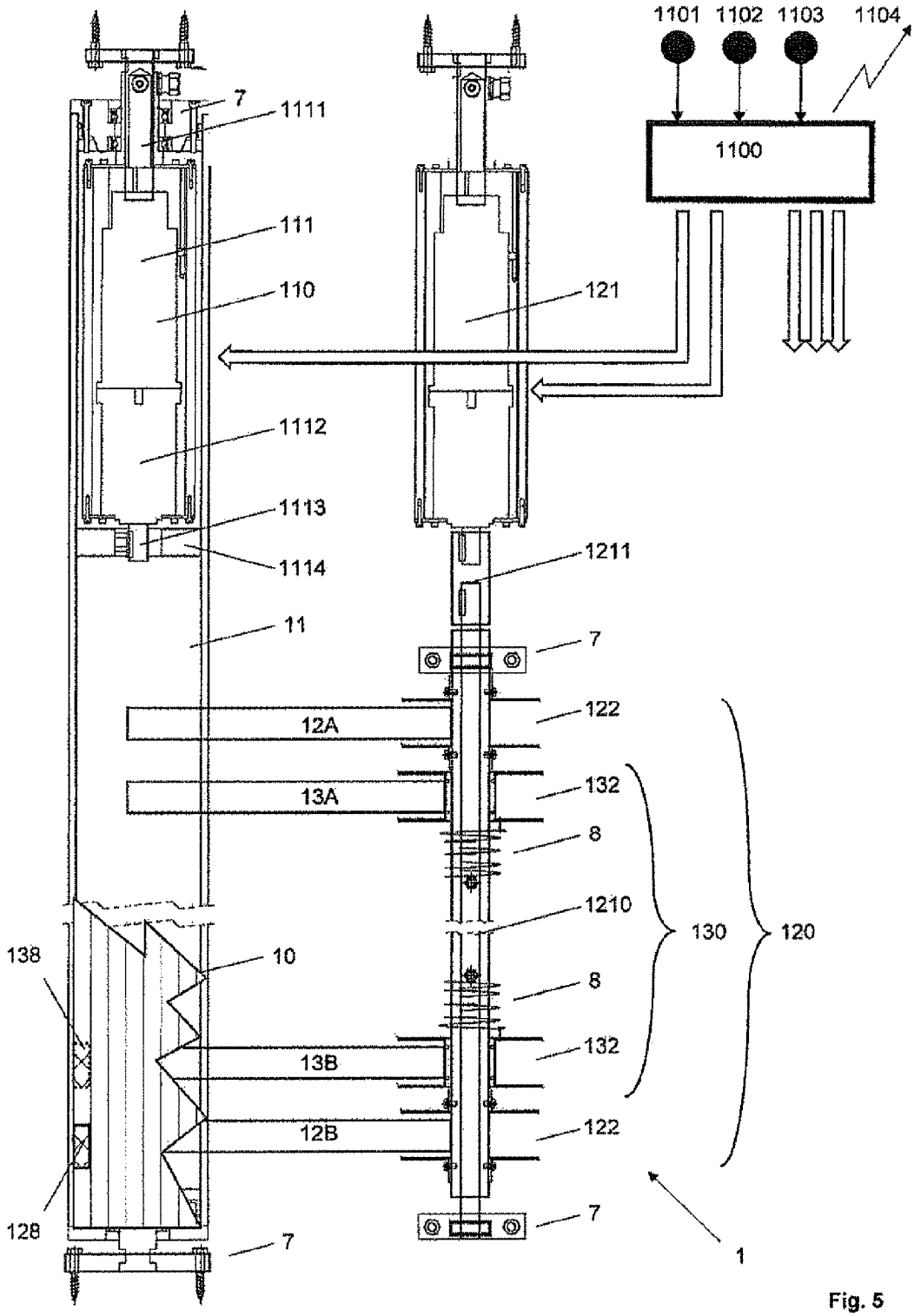
Figure 6:
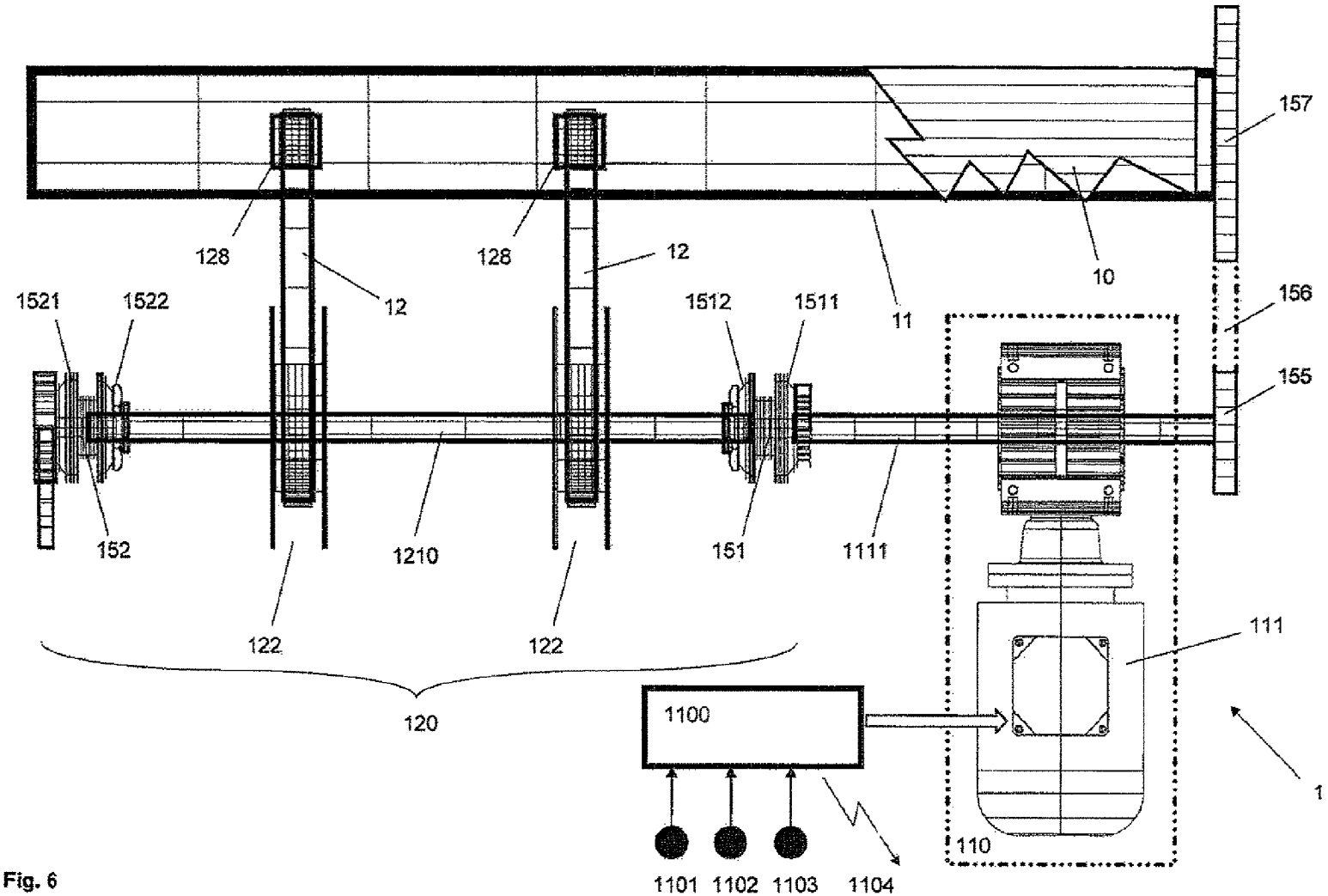
Figure 7:
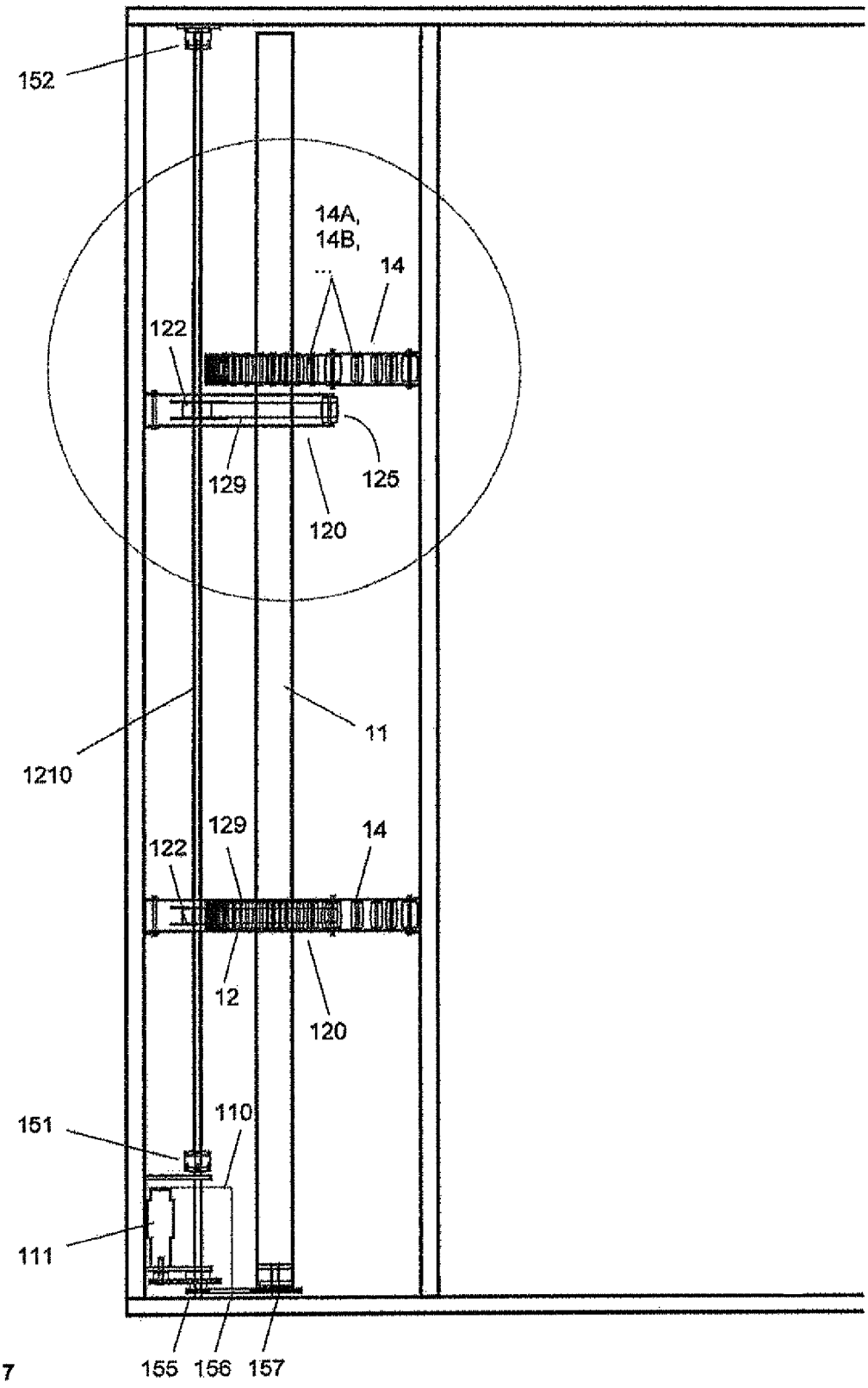
Figure 8A:
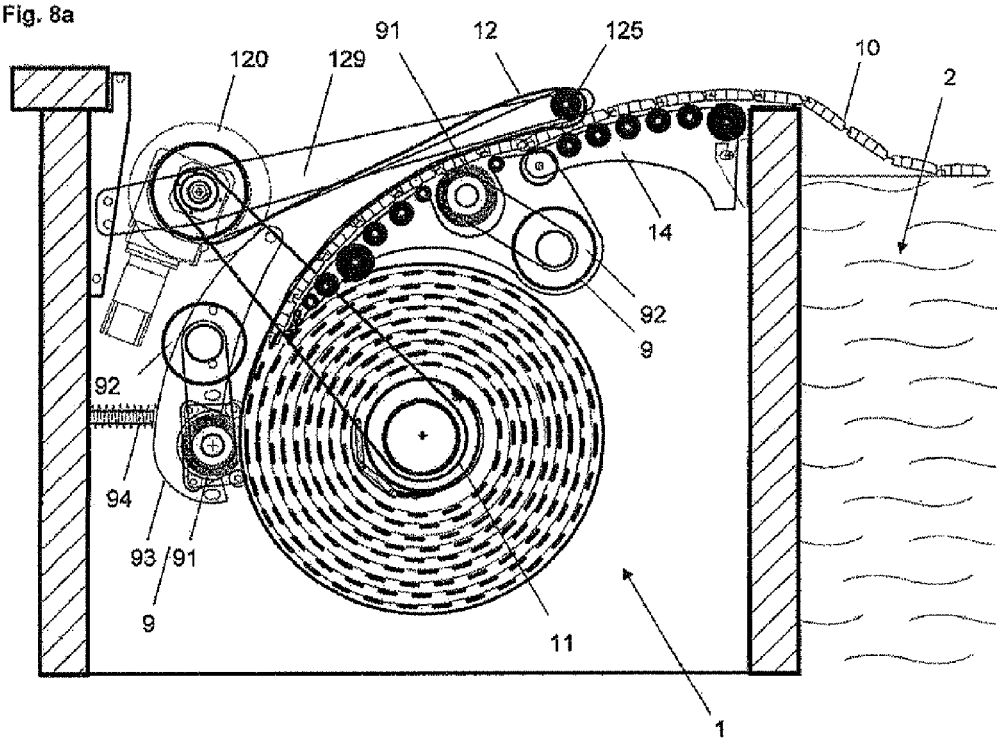
Figure 8B:
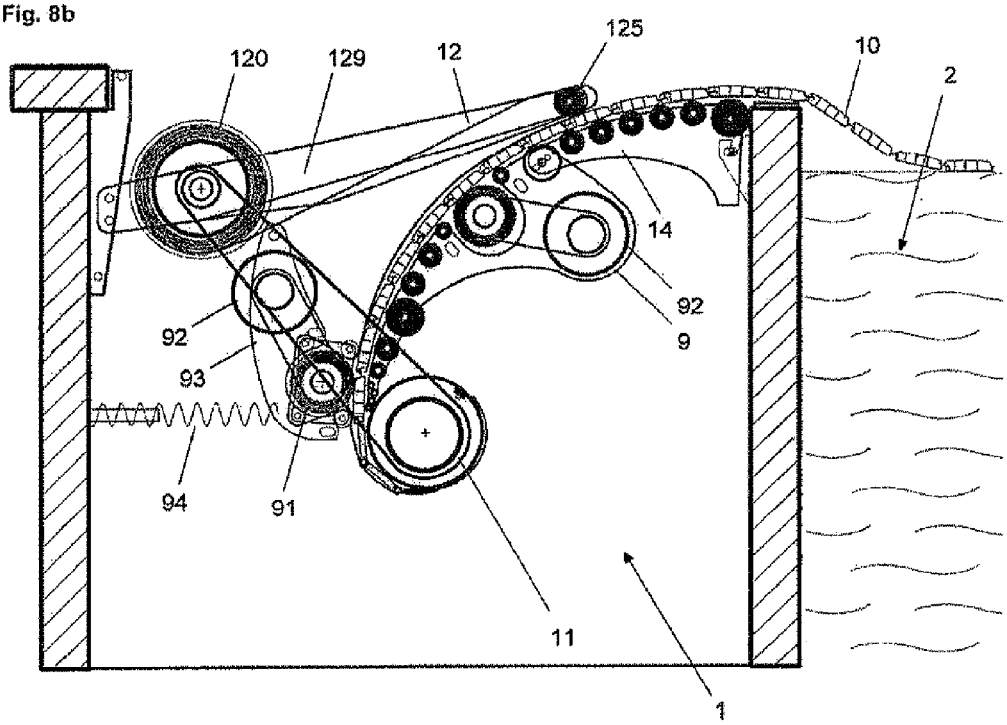

Below, the invention is described more closely with referenced to drawings, in which:

FIG. 1 shows, installed in a device compartment 3, an inventive drive device 1 with which a cover 10, which consists of profile elements 100 that are flexibly connected with one another, can be pulled via a deflection device 14 into the device compartment 3 or pushed out of it;

FIG. 2 the drive device 1 of FIG. 1 with the opened device compartment 3;

FIG. 3 a view from above into the opened device compartment 3;

FIG. 4*a* the drive device 1 of FIG. 1 in a preferred embodiment, in which the deflection device 14 is rotatably supported by means of a bearing element or an articulated joint 141;

FIG. 4*b* the drive device 1 of FIG. 4*a*, after unrolling the cover 10 from the winding shaft 11;

FIG. 5 a drive device 1 in a preferred embodiment with a drive unit 110 that is integrated into the winding shaft 11 and with a separate drive unit 121 that by means of a reel shaft 1210 drives two tractive devices 120, 130;

FIG. 6 a drive device 1, which comprises only one drive unit 110 having a drive shaft 1111, that is firmly coupled via a first coupling device 155, 156, 157 with the winding shaft 11 and via a second coupling device 151 with a reel shaft 1210, which drives reels 122 of the first traction device 120;

FIG. 7 the drive device 1 of FIG. 6 in an overall view;

FIG. 8*a* the drive device 1 of FIG. 4*a* with cleaning devices 9 that are provided on both sides of the cover; and FIG. 8*b* the drive device 1 of FIG. 8*a*, after the cover 10 has been unrolled from the winding shaft 11.

FIG. 1 shows an inventive drive device 1, which serves for the transport of the cover 10 of a swimming pool 2. With the drive device 1 the flexible cover 10 can be pushed over the swimming pool 2 and can again be retracted therefrom.

The drive device 1 is installed in a device compartment 3 that is separated from the swimming pool 2 and that can be closed with a lid 4. By the separation from the swimming pool 2 the drive device 1 can be kept dry and protected from contamination and oxidation. Further, maintenance work, particularly cleaning work, can be executed on the drive device 1 without any problem.

The drive device 1 comprises a drive unit 110, having a winding shaft 11 which is coupled with a motor 111 and on which the cover 10 is rolled up. For example, the winding shaft 11 is a conventional axle, a pin, a reel or a drum.

The cover 10 is guided over a deflection device 14 to an outlet opening 35 of the device compartment 3 that is limited by a pool wall 31 and the lid 4. On the end facing the winding shaft 11, the cover 10 is connected to an outer tractive element 12 and, if appropriate, with an inner tractive element 13. It is shown, that the outer tractive element 12, the cover 10 and the inner tractive element 13 are rolled up partially on to the winding shaft 11 and are coupled therewith. Of central importance is the use of the outer tractive element 12, which is lying at the side of the cover 10 that is opposite to the side that faces the deflection device 14 and which pushes the cover 10 under tension against the deflection device 14. Further, the outer tractive element 12 is guided over an exit pulley 125, serving for deflection, to a first traction device 120, which rolls up the outer tractive element 12 by means of a drive unit 121 onto a reel 122. The traction device 120 therefore allows to tension the outer tractive element 12 and to set the winding shaft 11 into motion, so that not only the outer tractive element 12 is moved, but also the flexible cover 10 is unrolled from the winding shaft 11. The exit pulley 125 is located in the area of the outlet opening 35, for which reason the cover 10 is guided controlled by the outer tractive element 12 up to the outlet opening 35, where it can exit over an exit ramp 38. The exit pulley 125 is preferably mounted at the end of the lid 4 or on a separate lever 129 (see FIG. 4*a*) and can be held by the lever in an ideal position.

The deflection device 14 comprises two rotatably supported deflection pulleys 14A, 14B, around which an endless belt 149 is guided. The cover 10 is pressed by the outer tractive element 12 against the deflection pulleys 14A, 14B of the deflection device 14 and is guided by the deflection device 14. Therefore, several forces act on the cover 10 from different sides, from the front side and from above by the outer tractive element 12 and from below by the deflection device 14, which hold and pull the cover 10, when unrolling, towards the outlet opening 35.

In order to ensure that the application of force is effected by the outer tractive element 12 and the deflection device 14, the cover 10 is not guided along the shortest path to the outlet opening 35. The deflection device 14 is therefore shifted outwards relative to this shortest path or bent outwards. Hence, the cover 10 is pressed by the outer tractive element 12 with a force against this shortest path, until an equivalent counterforce is applied by the deflection device 14 on the other side on to the cover 10. Hence, the cover 10 is precisely guided along a curved path.

On the side of the cover 10 that is opposite to the side that faces the outer tractive element 12, an inner tractive element 13 is provided in this preferred embodiment, which is connected to the winding shaft 11 and which is held and can be tensioned by a second traction device 130. The second traction device 130 comprises at least one reel 132 that is driven by a drive unit 131 and that serves for the tensioning and rolling-up of the related inner tractive element 13. The inner tractive element 13 is guided starting from the winding shaft 11 via the deflection device 14 and a lower exit pulley 135 to the second traction device 130. The exit pulley 135 is also located close to the outlet opening 35, for which reason the cover is precisely guided on both sides up to the outlet opening 35. The outer tractive element 12 and the inner tractive element 13 therefore define a path, which must be followed by the flexible cover 10, so that the cover 10 can be pushed outwards without problems, and without the possibility that the cover can escape upwards or downwards. It can be seen, that the elements of the drive device 1 require only little space within the device compartment 3, for which reason a lot of free space is available for the accommodation of the cover 10. Hence, already with small dimensions of the device compartment 3 large covers 10 can be accommodated and large liquid containers or swimming pools 2, respectively, can be covered.

FIG. 1 schematically shows that the drive devices 110, 121, 131 in a preferred embodiment are coupled with one another via a coupling device 150, e.g. a differential gear 150. In this case only one motor 111 is required, which drives the drive shafts of the first, the second and the third drive unit 110, 120, 130. In this way, said drive units 110, 120, 130 are mechanically coupled with one another. However, the firm mechanical coupling of the drive units 110, 120, 130 is preferably avoided, so that different motion speeds can be compensated. For example, sliding-hubs or free-wheels or overrunning clutches, respectively, are used, as this is described below with reference to the device of FIG. 6. Alternatively, drive units 110, 120, 130 can be used that are mechanically independent from one another and that are synchronised electronically with one another by means of control technology, as this will be described below with reference to the device of FIG. 5.

The device compartment 3 can be covered by means of a lid 4, which in the shown embodiment of the drive device 1 is pivotally held by mounting devices 41 at the side facing the swimming pool 2. As schematically shown in FIG. 2, the lid 4 can therefore be opened from the side of the ground, in order to access the device compartment 3 and to perform maintenance work on the device. In order to hold the lid 4 in the opened position, a locking bar is provided. In this position of the lid 4 the cover 10 can be extracted towards and maintained from the side of the ground.

For holding and adjusting of the lid 4 a particularly uncomplicated device is provided. FIG. 1 shows that within the device compartment 3, at the outer wall 33 opposing the pool wall 31, a bracket 51 is mounted. This bracket 51 serves for holding a support arm 5, which is connected to the lid 4 and is connected to the bracket on the front side by means of a mounting screw 511. By turning the mounting screw 511 the support arm 5 can further be drawn downwards, till it abuts to a support lever 52, which is connected via an articulated joint 513 to the bracket 51. This support lever 52 can be turned by means of an adjustment screw 512, which is rotatably held by the bracket 51 in a threaded bore. By turning the adjustment screw 512 the inclination of the support arm 5 and thus of the lid 4 can precisely be adjusted.

The device compartment 3, which is delimited by the pool wall 31, outer walls 33 and the ground 32, can be made as required. For this purpose wooden walls or masoned walls can be provided. The winding shaft 11 is arranged in the centre, while the first traction device 120, and the second traction device 130, which is provided if appropriate, are preferably arranged peripherally.

FIG. 3 shows a view from above into the opened device compartment 3, after removal of the cover. It can be seen that the winding shaft 11 traverses the device compartment 3 completely and that the traction device 120 and deflection devices 14 require only a little space. The optionally provided second traction device 130 is not shown. Further shown are two brackets 51 with support arms 5, which support the lid 4. The schematically shown deflection devices 14 and tractive elements symbolise, that numerous different embodiments can be realised.

FIG. 4*a* shows the drive device 1 of FIG. 1 which is provided with the first traction device 120 only, and by which the deflection device 14 is rotatably supported. The deflection device 14 comprises an arm 140, which on one point, preferably approximately in the centre, is rotatably held by means of a bearing or articulated joint 141. Along the arm 140 several rolls or wheels 14A, 14B, 14C, . . . are arranged, which optimally guide the cover 10. With rolling up or unrolling the cover 10 the diameter of the coiled cover 10 changes continuously. Due to rotatably supporting, the deflection device 14 can follow the diameter of the coiled cover 10 with the front sided end piece, so that the cover 10 is always optimally guided and undesirable stresses are avoided.

FIG. 4*b* shows the drive device 1 of FIG. 4*a*, after the unrolling of the cover 10 from the winding shaft 11. In this state, the front sided end piece of the deflection device 14 is lying on the winding shaft 11. Due to the optimal guidance of the cover 10 with the preferably embodied deflection device 14 and the stable embodiment of the first traction device 120 a second traction device is not needed in this embodiment.

FIG. 5 shows a drive device 1 in a further preferred embodiment, in which the first drive unit 110 is integrated into the hollow cylindrical winding shaft 11 and supports the drive shaft 11 on one side. The first drive unit 110 consists of an electro motor 111, which is connected via a gear 1112 and a drive shaft 1113 with a coupling disc 1114. The motor 111 is designed as an external rotor motor. The inner stator with the related stator axle 1111 is stationary held. The outer rotor can freely turn within the winding shaft 11 together with the gear 1112, for example a planetary gear, whose exiting axle 1113 is connected to the coupling disc 1114. The coupling disc 1114 is wedged within the winding shaft 11 and rigidly coupled with it. For the stabilisation of the winding shaft 11 it is further supported on the side of the drive with a bearing 7, which turns around the stator axle 1111 and holds the winding shaft 11. The winding shaft 11 is therefore held on both sides by means of bearing elements 7, for which reason the first drive unit 110 is unburdened and is merely required to provide the drive torque. The installation of the drive unit 110 into the winding shaft 11 saves space and is highly efficient. The winding shaft 11 can practically extend over the whole breadth of the device compartment 3, for which reason the device compartment 3 can exhibit relatively small dimensions. Preferably it is provided that the first drive unit 110 can drive the winding shaft 11 in both directions and can roll up the cover 10 clockwise or anticlockwise.

FIG. 5 further shows that in this preferred embodiment two tractive devices 120, 130 are provided, which comprise a common drive shaft or reel shaft 1210, which is connected to a second drive unit 121 via a coupling element 1211. Alternatively, for each traction device 120 or 130 a separate reel shaft can be provided, which is driven by separate drive units or by a single drive unit e.g. via a differential gear. The second traction device 130 is not required, if the first traction device 120 is provided with enough strength.

In FIG. 5 it is further shown that the first and the second drive unit 110, 121 can identically be designed. However, for the first and/or the second drive unit 121 conventional motors can be used 111, which are externally supported. On the reel shaft 1210 two reels 122 of the first traction device 120 and two reels 132 of the second traction device 130 are provided. The two reels 122 of the first traction device 120 serve for rolling-up of outer tractive elements 12, preferably ribbons. The two reels 132 of the second traction device 130 serve for the rolling-up of inner tractive elements 13, preferably ribbons. As shown in FIG. 5, the end pieces of the ribbons 12, 13 are mounted by means of coupling pieces 128, 138 at the corresponding sides at the end of the cover 10. The tractive elements 12, 13 can also directly be coupled with the winding shaft 11 in an uncomplicated manner. For example, the hollow cylindrical winding shaft 11 is provided with openings, into which the cover 10 and on both sides thereof the tractive elements 12, 13 are engaged. Furthermore it is possible to drive each individual reel 122, 132 with a separate motor.

Symbolically it is shown, that that at least two reels 132 of the second traction device 130 are coupled by elastic elements 8, e.g. coil springs, with a common drive shaft 1210. By means of the elastic elements 8 differences of motion speeds of the tractive elements 12, 13 can be compensated and the tractive elements 12, 13 can uniformly be tensioned.

This embodiment of the drive device 1 is particularly advantageous, because the winding shaft 11 and the drive shaft 1210 require only little space and the device compartment 3 is available essentially for the accommodation of the cover 10.

As shown in FIG. 6, the inventive drive device 1 can advantageously also be equipped with only one drive unit 110 and with only one motor 111. The drive shaft 1111 of the motor 111 is firmly coupled with the winding shaft 11 via a first coupling device, consisting of a first toothed wheel 155, a toothed belt or a toothed chain 156, as well as a second toothed wheel 157 and can drive them in both directions. On the other side the drive shaft 1111 is connected via a second coupling device 151 with the reel shaft 1210, which drives the reels 122 of the first traction device 120. On the side opposite to the second coupling device 151 the reel shaft 1210 is held by a third coupling device 152. The second and the third coupling device 151, 152 comprise each a first or second free-wheel 1511; 1521, respectively, and a first or second sliding-hub 1512; 1522, respectively. The free-wheel 1511; 1521 allows the reel shaft 1210 and the sliding-hubs 1512; 1522 to turn freely in one direction, while turning into the other direction is blocked. The blocked sliding-hubs 1512; 1522 allow the reel shaft 1210, under appropriate impact of force or starting from a specific moment of a torque to turn, so that when the reel shaft 1210 is turned, speed differences with respect to the winding shaft 11 can be compensated or that the reel shaft 1210 can be turned, when the free-wheel 1511 of the second coupling device 151 prevents the first sliding-hub 1512 from turning, so that the tractive element 12 is firmly tensioned during rolling-up of the cover 10. Therefore, by using the first free-wheel 1511 and the first sliding-hub 1512 the rigid coupling with the drive shaft 1111 and consequently with the winding shaft 11 is cancelled. With changing diameter of the cover 10 the required adaption of the rotational speed of the reels 122 and the reel shaft 1210, respectively, to the speed, with which the cover 10 is unrolled from the winding shaft 11, is achieved with a slip that is achieved by means of the first sliding-hub 1512.

When rolling up the cover 10, the free-wheel 1511 of the second coupling device 151 is unlocked, i.e. the drive shaft 1111 and the reel shaft 1210 are decoupled from one another. However, the free-wheel 1521 of the third coupling device 152 locks the related sliding-hub 1522, for which reason the reel shaft 1210 can only turn then, when the winding shaft 11 pulls the cover 10 with a sufficiently high traction force and sets the second sliding-hub 1522 into motion. In this manner the (outer) tractive elements 12 constantly remain firmly tensioned.

When unrolling the cover 10 the free-wheel 1511 of the second coupling device 151 is locked, for which reason the drive shaft 1111 and the free-wheel 1511 of the second coupling device 151 drive the first sliding-hub 1512. The drive shaft 1111 and the reel shaft 1210 are therefore coupled with one another via the first sliding-hub 1512. However, the free-wheel 1521 of the second coupling device 152 is locked, for which reason the reel shaft 1210 is not hampered by the second coupling device 152. With the rotation of the drive shaft 1111 the reels 122 are turned and the (outer) tractive elements 12 are tensioned and rolled up. Since the cover 10 is not given free by the winding shaft 11 with the required speed, an impact of force is acting on to the sliding-hub 1512 of the second coupling device 151, so that a slip occurs that causes an adaptation of speed.

FIG. 7 shows the drive device 1 of FIG. 6 in an overall view. The deflection device 14, that is provided with pulleys and the traction device 120, which are shown separated from one another at a position marked with a circle, however lie above one another during operation. The drive unit 110 provided for the drive of the winding shaft 11 and the reel shaft 1210 requires only little space.

The embodiment of the drive device 1 shown in FIGS. 6 and 7 is therefore particularly uncomplicated, cost-effective and space-saving. Since all parts of the drive device 1, including the sliding-hubs, are scarcely stressed and are available on the market with high-quality and with high load capacity, a drive device 1 is obtained, that scarcely requires maintenance.

In order to consequently ensure sanitation and cleanliness of the complete system, preferably one or two cleaning devices 9 are integrated into the drive device 1, as shown in FIGS. 8*a* and 8*b*. The cleaning devices 9 comprise a drive motor 92, which, via drive means, drives a rotatably supported brush 91, which acts on the lower side or on the upper side of the cover 10, respectively, and liberates it from contamination, that is locally collected and preferably disposed through a drain.

The cleaning device 9 provided on the lower side of the cover 10 is coupled in this embodiment with the deflection device 14 and thus pushes the brush 91 consequently against the cover 10.

The cleaning device 9 provided on the upper side of the cover 10 comprises a lever 93 that is rotatably supported and that is provided with a drive motor 92 and the brush 91, which is pushed against a cover 10 with a drive means 94, e.g. a spring. Both FIGS. 8*a* and 8*b* show that the cleaning devices 9 continuously act optimally on the cover 10 independently of its winding state. The cleaning devices 9 may further comprise jets for the supply of water, with which contamination is flushed away.

As shown in FIGS. 5 and 6, the provided drive units 110, 121 or 110, respectively, and preferably also the provided cleaning devices 9 are preferably connected to a control unit 1100, which provides the required operating functions, such as the synchronisation of the possibly provided drive units 110, 121 and the actuation of the cleaning devices. The control unit 1100 is preferably provided with an operation program, which may fulfil additional functions and which may be configurable by the user. Preferably it is provided, that the air temperature and the water temperature and/or the light incidence are measured by means of sensors 1101, 1102 and the drive device 1 is controlled in such a way, that the cover 10, which preferably serves for the thermal insulation, is always pulled in or rolled up, when solar radiation is present and is extended, when the ambient temperature is lower than the water temperature and no solar radiation is present.

By these measures it is possible to use solar energy optimally in order to heat the water of the swimming pool 2. It can also be arranged that the swimming pool 2 always gets covered at the onset of darkness, so that accidents can be prevented. For this purpose also a time switch 1103 can be provided, with which the drive device 1 is controlled. Further, preferably a radio unit 1104 is provided, which allows the user to operate the drive device 1 by wireless control.

The inventive drive device 1 can be used for any liquid container that for any reason requires temporary covering. The inventive drive device 1 can also be advantageously used in the food industry and in the chemical industry in order to cover liquids during the production process for protection against influences from outside and to give the liquids free, in order to add or take out material. Thereby, the cover 10 can, as well as the drive mechanism, be adapted to the particular requirements.

REFERENCES

[1] DE2756738A1
[2] EP1754846A1
[3] U.S. Pat. No. 5,761,750A

The invention claimed is:

1. A drive device for a flexible cover of a liquid container, which drive device is installed or installable in a device compartment that is arranged separate from the liquid container and with which the cover can be moved over the liquid container and can again be retracted from the liquid container, with a winding shaft that interacts with the cover and that is coupled to a first drive unit, wherein the winding shaft serves for rolling-up the cover, that is guided over a deflection device, which comprises an arm that is pivotally supported by an articulated joint, to an outlet opening of the device compartment and, at an end facing the winding shaft, is connected to an outer tractive element, and the cover is held and guided between the arm of the deflection device and the outer tractive element, which is held and can be tensioned by a first traction device so that the outer tractive element under tension presses the cover against the deflection device.

2. The drive device according to claim 1, wherein the deflection device is curve shaped, and is provided with one or more deflection pulleys.

3. The drive device according to claim 1, wherein the deflection device is designed in such a way, that the cover runs over a bent path to the outlet opening of the device compartment.

4. The drive device according to claim 1, wherein the first traction device comprises at least one first reel shaft that is driven by the first or a second drive unit and that is provided with a reel, which serves for rolling-up the outer tractive element.

5. The drive device according to claim 1, wherein the outer tractive element is connected to the winding shaft or with the end of the cover that is facing the winding shaft.

6. The drive device according to claim 1, wherein the outer tractive element is guided over an upper exit pulley to the first traction device, and the upper exit pulley is located at the outlet opening of the device compartment, through which the cover is expelled towards the liquid container.

7. The drive device according to claim 1, wherein the outer tractive element is made from plastic, textile material or metal and is embodied as rope or ribbon with a breadth in the range of 1 cm to 20 cm.

8. The drive device according to claim 1, wherein the cover comprises profile elements that are flexibly connected with one another and that are aligned perpendicular to the direction of transport, which profile elements are buoyant and/or are guided by a guide device along the edge of the liquid container.

9. The drive device according to claim 4 wherein the winding shaft is fixedly coupled via a first coupling device with the first drive unit and that the at least one reel shaft is coupled with a second drive unit or via a second coupling device, which comprises a compensating device, with the first drive unit.

10. The drive device according to claim 9, wherein the reel shaft is held on one side by the first coupling device and on the other side by a second coupling device, which comprises a free-wheel each, which hold a sliding-hub each and which block in a first and second direction of rotation respectively, that are opposed to one another, wherein the sliding-hub releases the reel shaft when a sufficiently high turning moment occurs.

11. The drive device according to claim 9, wherein the first drive unit is integrated into the winding shaft.

12. The drive device according to claim 9, wherein the winding shaft can be driven by the first drive unit in both directions.

13. The drive device according to claim 1, wherein a cleaning device is provided on the upper side and/or the lower side of the cover, which comprises a brush that is driven by a motor and that abuts on corresponding side of the cover.

14. The drive device according to claim 1 wherein the first drive unit and the provided tractive devices are controllable by a control unit depending on signals and data, which are derived from sensors or are stored in the control unit by the user.

15. The drive device according to claim 1, wherein the liquid container is a swimming pool.

* * * * *